United States Patent [19]

Garrigues

[11] 4,073,727

[45] Feb. 14, 1978

[54] PROCESS FOR THE OXIDATION OF WASTE LIQUORS ARISING FROM THE MANUFACTURE OF PAPER PULP

[75] Inventor: Yves G. Garrigues, Rueil-Malmaison, France

[73] Assignee: Groupement Europeen de la Cellulose, Paris, France

[21] Appl. No.: 453,046

[22] Filed: Mar. 20, 1974

[30] Foreign Application Priority Data

Mar. 28, 1973 France ..... 73.11209

[51] Int. Cl.[2] ..... C02B 1/34

[52] U.S. Cl. ..... 210/63 R; 162/65

[58] Field of Search ..... 210/63, 60, 61; 261/122; 162/31, 65

[56] References Cited

U.S. PATENT DOCUMENTS

| | | | |
|---|---|---|---|
| 2,690,425 | 9/1954 | Moses et al. | 210/63 X |
| 2,774,585 | 12/1956 | Wirts | 261/122 |
| 3,178,260 | 4/1965 | Tirado | 210/63 X |
| 3,207,572 | 9/1965 | Saul | 162/31 |
| 3,545,731 | 12/1970 | McManus | 261/122 |
| 3,696,929 | 10/1972 | Shah | 210/63 X |

*Primary Examiner*—Thomas G. Wyse

*Attorney, Agent, or Firm*—Lewis H. Eslinger

[57] ABSTRACT

A process for the oxidation of waste liquors arising from the manufacture of paper pulp.

The process consists of introducing the liquor into a reservoir comprising a series of candles consisting of a sintered material, arranged above the bottom of the reservoir, air being blown through these candles into the liquor which is kept at 70° to 90° C during the oxidation.

5 Claims, 2 Drawing Figures

PROCESS FOR THE OXIDATION OF WASTE LIQUORS ARISING FROM THE MANUFACTURE OF PAPER PULP

This invention is concerned with a process for the oxidation of waste liquors (also known as black liquors and white liquors) arising from the manufacture of paper pulp.

It is known to concentrate black liquors in a multiple-action evaporator and then to burn the concentrated liquor in a furnace, particularly with a view to recovering chemical products therefrom. Since the concentration of the liquor is often inadequate when it leaves the evaporator, the liquor is frequently further concentrated, before combustion, in an evaporator by direct contact with the hot combustion gases issuing from the furnace. The carbon dioxide present in the combustion gases lowers the pH of the alkaline liquor at the liquid-gas interface and hydrogen sulphide is thus liberated from the sodium sulphide present in the liquor. Unpleasant smells are therefore given off by the furnace chimney.

In existing factories, or in new factories where this conventional process is to be used, it is therefore necessary to reduce the sodium sulphide content of the black liquor before the latter enter the furnace. The most commonly used process for doing this consists of oxidising the black liquor in the liquid phase by means of air, before evaporation or after evaporation.

The oxidation of the dilute liquor, that is before evaporation, suffers from three major disadvantages: (i) formation of carbonates, which increase the problem of scaling in the evaporator tubes, (ii) the danger of reforming sulphides through reversion of the oxidation products in the evaporator tubes, and (iii) insufficient oxidation yield to comply with the specifications in force.

On the other hand, oxidation of the concentrated liquor, that is after evaporation, has hitherto suffered from the disadvantage of requiring elaborate equipment and of having a high power consumption.

We have now developed an oxidation process which requires much simpler equipment and a smaller power consumption and which is based upon the formation of a very intimate mixture of the black liquor with air. The process is furthermore applicable to the oxidation of other liquors used in papermaking.

According to the invention, there is provided a process for the oxidation of an aqueous liquor containing caustic soda and sodium sulphide arising from the manufacture of paper pulp, which comprises oxidising the liquor in a reservoir in which are located horizontally disposed candles of a sintered material through which air for oxidation is blown, the oxidation being carried out at a temperature of from 70° to 90° C.

Figure 1:
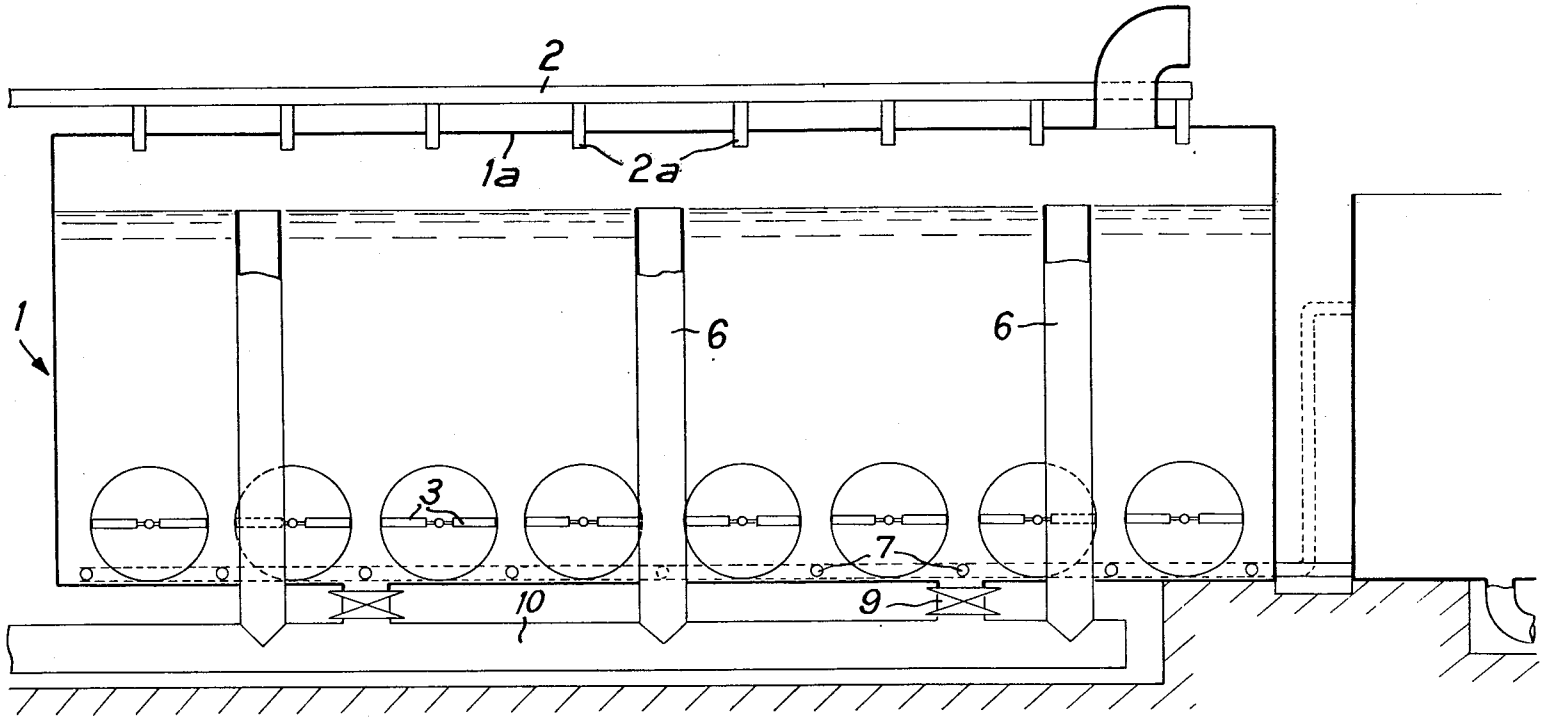
Figure 2:
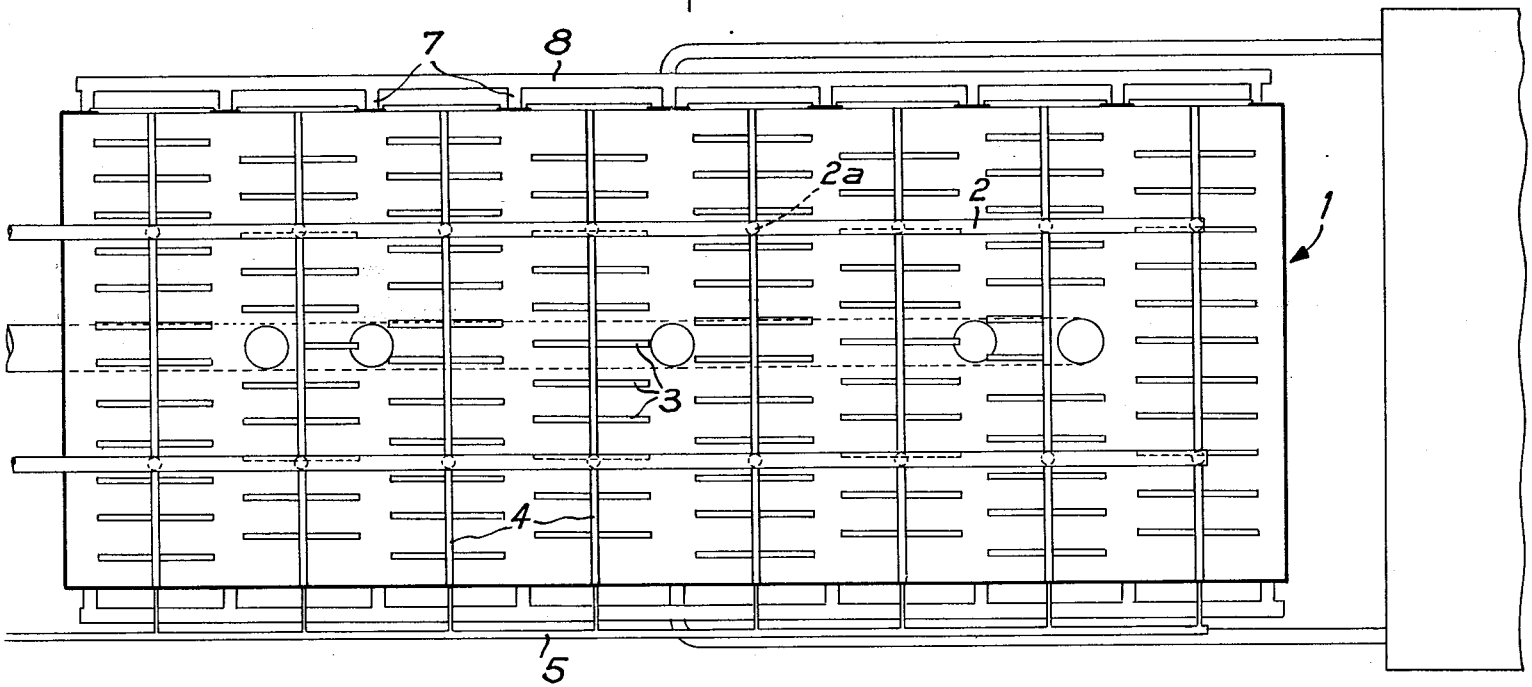

Further features and advantages of the invention will appear from the following description, given by way of example, and from the accompanying drawings, in which:

FIG. 1 is a view, in longitudinal section, of a preferred embodiment of installation for the oxidation of liquor in accordance with the process of the invention, and FIG. 2 is a plan view of the installation of FIG. 1.

The aqueous liquor containing caustic soda and sodium sulphide is supplied to a reservoir 1 through two pipelines 2 disposed above the reservoir, the pipelines 2 being provided with branches 2a which pass through the cover 1a of the reservoir and which serve to discharge the liquor uniformly into the reservoir.

Forty centimeters above the bottom of the reservoir, candles 3 are mounted horizontally, in a fish bone arrangement, on either side of pipelines 4 which, in turn, are connected to a manifold 5 for supplying the air blown in. The candles 3 are made of sintered stainless steel with 3 to 5 micron pores.

The air blown through these candles forms very fine air bubbles of large specific surface area, which makes it possible to increase the speed of the oxidation reaction.

As the oxidation is carried out at from 70° to 90° C, heated air is passed into the candles, which also avoids the formation of solid deposits on the surface of the candles.

The reservoir is provided with three overflows 6 and is laterally provided with withdrawal connections 7 which are joined to manifolds 8, whilst the bottom of the reservoir is provided with two discharge orifices each equipped with a valve 9 and connected to the discharge manifold 10 into which the overflows 6 open.

Using such an installation, and following the oxidation process according to the invention, the oxidation reservoir was supplied with 53 $m^3$ of black liquor/hour, the liquor having a solids content of 55% by weight derived from various deciduous timbers and a sodium sulphide content of 12 g/l. For a dwell time of 45 minutes and a reaction temperature of 80° C, an air flow of 1,650 $Nm^3$/hour at an effective pressure of 0.55 kg/$cm^2$ (the pressure loss in the candles 3 being less than 0.35 kg/$cm^2$) was required, the volume of air used being 1.8 times the volume of air stoichiometrically required for the oxidation. The black liquor which issued had a solids content of 56% and a sulphide content of less than 0.1 g/l, representing an oxidation yield of 99.2%.

White liquors can also be oxidised in a similar installation. Thus, the reservoir was supplied with 2.5 $m^3$/hour of a white liquor containing 29 g/l of sodium sulphide, 100 g/l of caustic soda, and 30 g/l of sodium carbonate. For a dwell time of 4 hours and at a temperature of 90° C, an air flow of 275 $Nm^3$/hour under 0.55 kg/$cm^2$ pressure was required, this volume of air being 2.6 times the stoichiometric volume of air required to oxidise the sulphide. The liquor left the reservoir with a sulphide content of less than 0.2 g/l, representing an oxidation yield of 99.3%.

The invention is not limited to the process described above: in particular, it is possible to heat the liquor by means of a steam coil placed in the bottom of the reservoir.

What is claimed is:

1. In a process for the oxidation of an aqueous liquor containing caustic soda and sodium sulphide arising from the manufacture of paper pulp, the improvement which comprises: oxidizing the liquor in a reservoir in which are located horizontally disposed candles of a sintered material through which air for oxidation is blown, the air for oxidation being introduced into the candles at about 90° C and oxidation being carried out at a temperature of from 70° to 90° C.

2. A process according to claim 1, wherein the candles are made of sintered stainless steel and have 3 to 5 micron pores.

3. A process according to claim 2, wherein the liquor treated is a black liquor containing lignin at a solids content of 48 to 50% by weight and oxidation is effected for about 45 minutes using a volume of air which is at least the volume theoretically required for the oxidation and is less than twice said volume.

4. A process according to claim 2, wherein the liquor treated is a white liquor and oxidation is effected for about four hours using a volume of air which is about 2.6 times the volume of air theoretically required for the oxidation.

5. A process according to claim 1, wherein the candles are arranged at about 40 centimeters from the bottom of the reservoir and the liquor level in the reservoir is maintained at about 2 meters from the bottom of the reservoir, the liquor being introduced into the reservoir at the top and being withdrawn laterally just above the bottom.

* * * * *